US008292085B2

(12) United States Patent
Bingham

(10) Patent No.: US 8,292,085 B2
(45) Date of Patent: Oct. 23, 2012

(54) RUN-OF-MINE COAL SEPARATOR

(76) Inventor: Harold L. Bingham, Richmond, KY (US)

( * ) Notice: Subject to any disclaimer, the term of this patent is extended or adjusted under 35 U.S.C. 154(b) by 333 days.

(21) Appl. No.: 12/686,148

(22) Filed: Jan. 12, 2010

(65) Prior Publication Data

US 2011/0168606 A1 Jul. 14, 2011

(51) Int. Cl.
*B07B 4/00* (2006.01)

(52) U.S. Cl. ..... 209/135; 209/3; 209/13; 209/20; 209/136; 241/21; 241/60

(58) Field of Classification Search ..... 209/135, 209/142, 147, 149, 919, 20, 21
See application file for complete search history.

(56) References Cited

U.S. PATENT DOCUMENTS 3,333,692 A * 8/1967 Eveson et al. ..... 209/474
3,696,923 A 10/1972 Miller
3,799,339 A * 3/1974 Breitholtz et al. ..... 209/639
3,957,630 A * 5/1976 Mooradian ..... 209/136
3,970,547 A * 7/1976 Theodore et al. ..... 209/136
4,002,559 A * 1/1977 Paterson et al. ..... 209/3
4,052,797 A * 10/1977 Christensen ..... 34/242
4,107,034 A * 8/1978 Paterson et al. ..... 209/135
4,164,467 A 8/1979 Liller
4,217,207 A 8/1980 Liller
4,341,352 A 7/1982 Liller
4,678,588 A * 7/1987 Shortt ..... 210/788
5,022,982 A * 6/1991 Greeley ..... 241/60
5,180,612 A * 1/1993 Rendell ..... 427/372.2
5,231,806 A * 8/1993 Swain ..... 451/88
5,868,256 A * 2/1999 Teppo ..... 209/173
6,889,842 B2 5/2005 Sandlin et al.

OTHER PUBLICATIONS van Houwelingen, Jan A., et al.—Dry Cleaning of Coal: Review, Fundamentals and Opportunities, Geologica Belgica, Jul. 3-4, 2004: 335-343.
Oder, R.R., et al.—Dry Coal Cleaning in a MagMill, EXPORTech Company, Inc., New Kensington, Pennsylvania.

* cited by examiner

*Primary Examiner* — Terrell Matthews
(74) *Attorney, Agent, or Firm* — James C. Eaves, Jr.; Brian W. Chellgren; Bingham Greenbaum Doll LLP

(57) ABSTRACT

A solids separation system and methods for use; the system having a barrel rotatably mounted in a substantially horizontal arrangement, a carriage on which the barrel is mounted and inclined so as to elevate the coal exit end of the barrel in relation to the rock exit end, a motor to rotate the barrel, a blower, a blower motor, a blade affixed to and helically wound along the interior surface of said barrel, and barriers between the turns of the blades to force the contents up into a stream of air supplied by a blower.

21 Claims, 5 Drawing Sheets

RUN-OF-MINE COAL SEPARATOR

RELATED U.S. APPLICATION DATA

Not applicable.

SUMMARY

The embodiments of the device and method relate to the physical separation of solids of substantially different densities by introducing the solids into a rotating barrel through which a stream of forced air is introduced. For purposes of explanation, and not meant to be limiting, the various embodiments are described as facilitating the separation of coal from rock by forced air. Additional embodiments of the device and method also permit the recovered solids to be separated into size based lots.

A first embodiment of the device consists generally of at least one barrel, at least one helical blade on the interior surface of the barrel, and at least one blower.

A further embodiment utilizes at least one barrel, at least one helical blade on the interior surface of a barrel, at least one blower, a hopper, a conveyer system, pop-ups (i.e. barriers) placed between the gaps in the helical barrel blade that runs along the interior of the barrel, a blower placed at one end of the barrel, and a collection area at the end of the barrel opposite the blower.

A mixture of solids, e.g. coal and rock, also known as "run-of-mine coal", is fed into various embodiments of the device from a hopper. The hopper is integrated into the device or it is a separate device apart from the separator itself. In an additional embodiment the hopper is affixed with a flow regulator to control the amount of coal exiting the hopper and entering the separator. An additional embodiment allows the hopper and/or the hopper contents to be mechanically agitated to facilitate the emptying of the hopper, e.g. mixing the ore or inducing a vibration in the hopper.

The contents of the hopper are dispensed onto a conveyer belt as part of a conveyor system. In an embodiment, the conveyer is configured so that the edges rise higher than the center, so as to act as a trough and prevent spillage over the sides as the mixture is being conveyed away from the hopper. In yet another embodiment, a traditional flat conveyor system may also be utilized. The conveyer carries the coal and rock into the separation barrel. At the end of the conveyer the coal and rock fall into the barrel of the device. In an additional embodiment, a wind barrier or shield is incorporated into the conveyor system and around the conveyer belt to prevent the coal and rock from being blown off the conveyer belt.

As the run-of-mine coal, or other mixture of solids of substantially differing densities empties into the barrel, the barrel turns in a manner so as to allow rock to be directed out of the rotating barrel by the helical blade to an exit point below the blower. In an embodiment of the device, the interior surface of the barrel also possesses barriers or ramps that run along the width of the barrel, in between turns of the spiral blade and roughly perpendicular to the blade. This forces the barrel contents up and over the barrier as the barrel rotates and makes them susceptible to the flow of high velocity air from the blower. The velocity of the air is regulated so as to be of insufficient force to blow rock out of the end of the barrel opposite the blower, thus allowing the rock to fall to the floor of the barrel to be removed by the turning helical blade and emptied out beneath the blower on the high density solids exit end of the barrel, but of sufficient force to blow coal out the low density solids exit end, i.e. opposite the blower. The blower size is proportional to the size of the barrel and the severity of the treatment is further refined based upon the density and size of the rock accompanying the coal.

In an embodiment, as coal is blown out of the rear of the barrel it is directed to collection bins which may or may not possess screens for further filtering. In another embodiment, the bins are collection hoppers. In a still further embodiment, the collection hoppers may empty onto conveyor systems to remove the segregated coal for remote storage or further separation.

DETAILED DESCRIPTION

Figure 1:
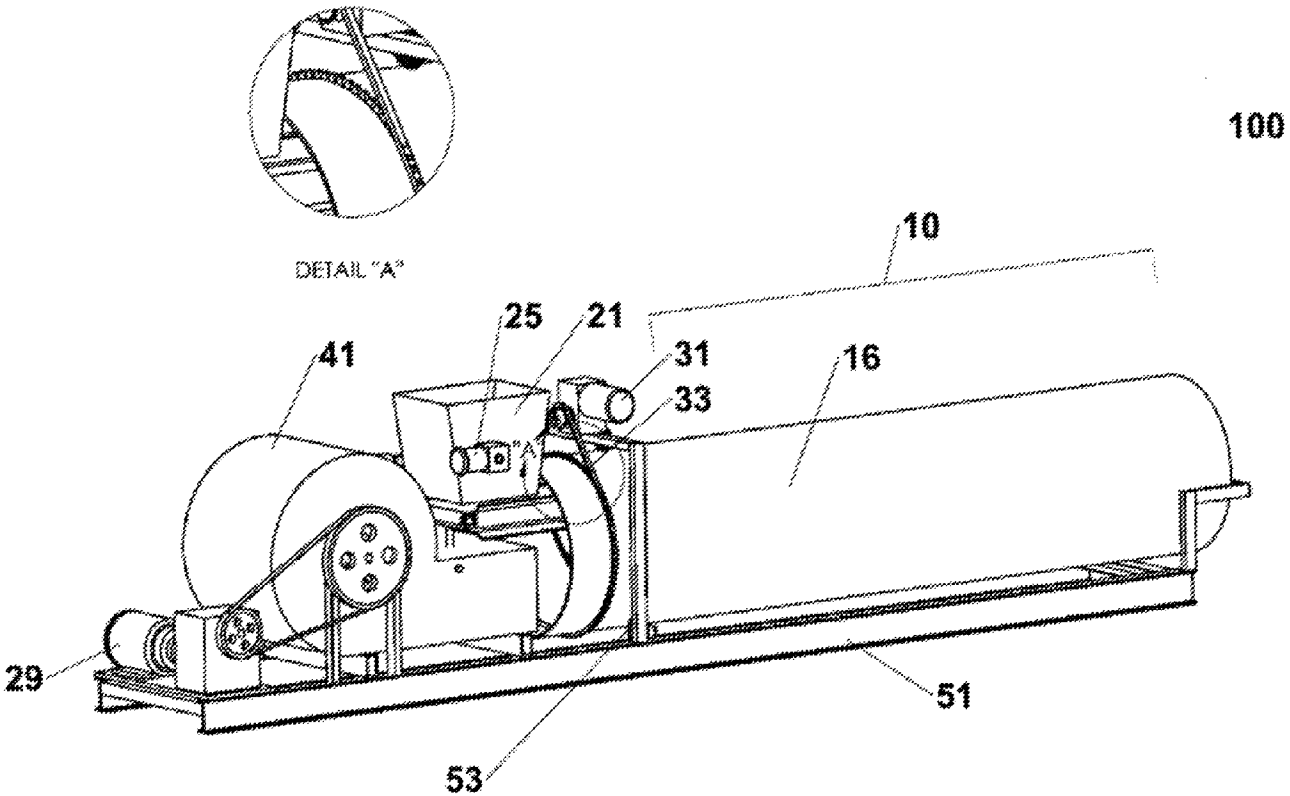
FIG. 1 is a perspective view of the separation system.
Figure 2:
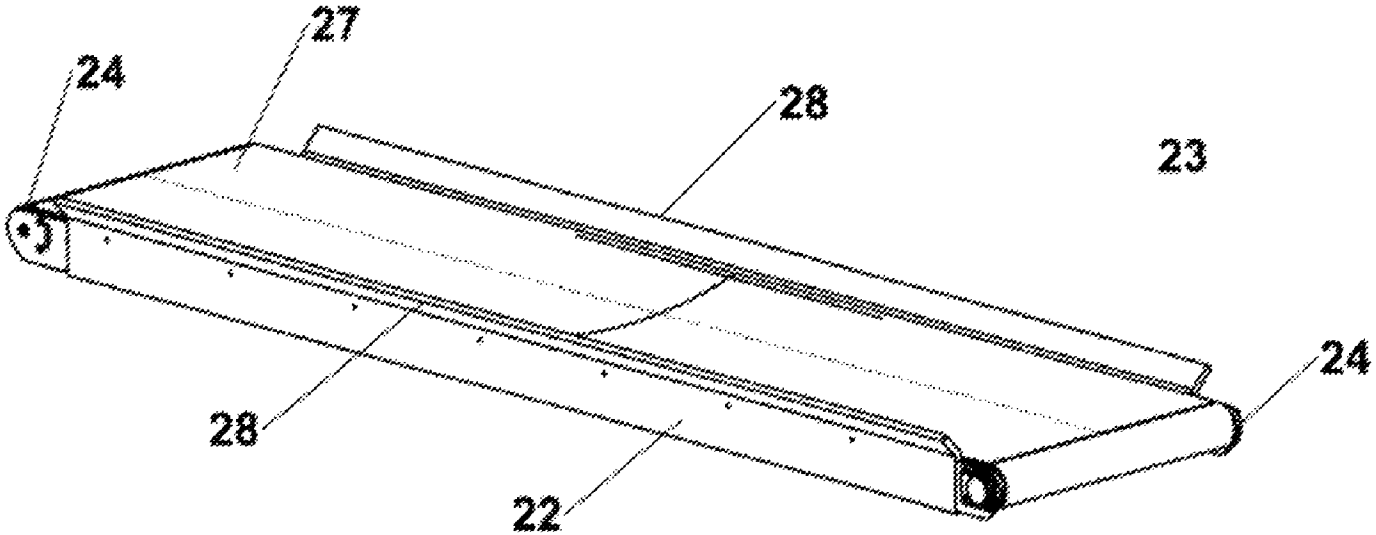
FIG. 2 is a cross-sectional view of the conveyor belt.
Figure 3:
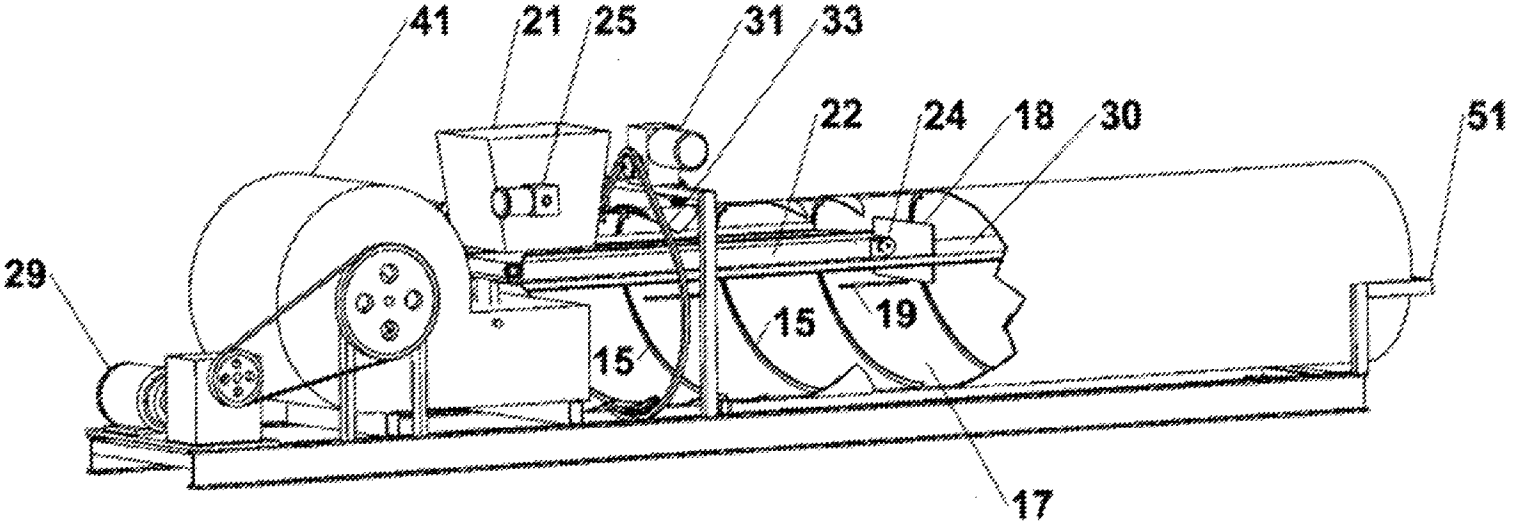
FIG. 3 is a cutaway view of the barrel exposing the helical blade and barriers.
Figure 4:
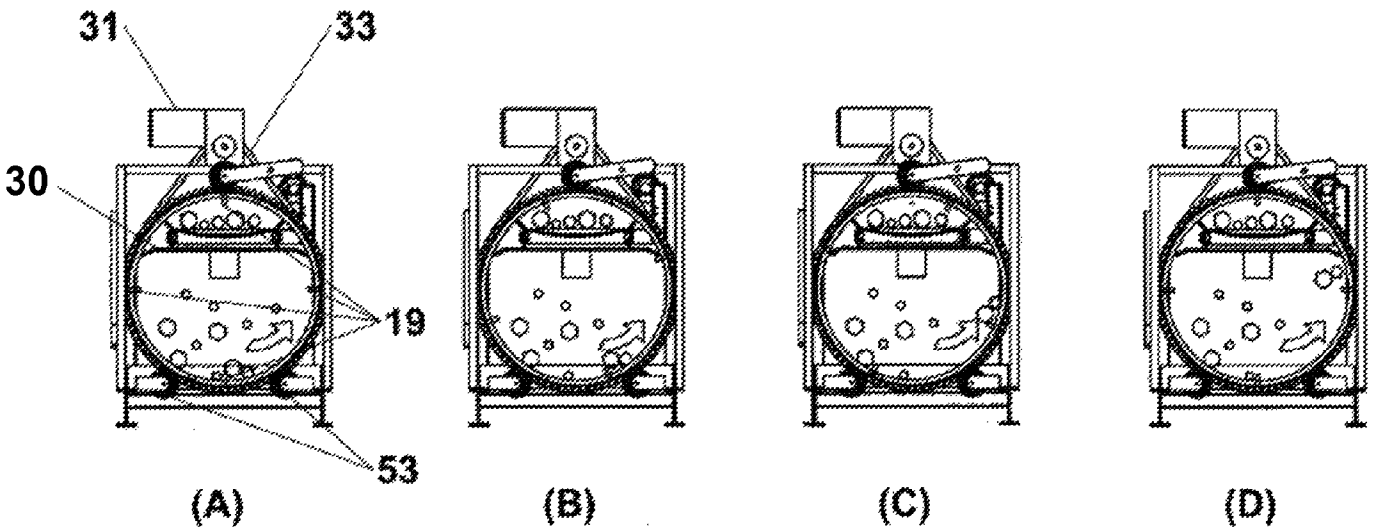
FIG. 4 is an illustration of the movement of coal and rock across the blade and barrier system at the base of the interior barrel surface.

The following are non-exclusive descriptions of multiple embodiments of the solids separation system. In one embodiment of the device, as depicted in FIG. 1, a mixture receptacle 21 (e.g. a hopper), is positioned above a conveyor belt system 23 outside of a long barrel 10 acting as the separator barrel 10. In one embodiment, a separator 100 is equipped with a flow regulator to control the rate at which a mixture enters the barrel 10. In yet another embodiment, a flow regulator is integrated into the mixture receptacle 21. A non-limiting example of one type of flow regulator is a sliding plate that is used to increase or decrease the size of the exit of the mixture receptacle 21. In an additional embodiment, the mixture receptacle 21 contents are affected by an agitator 25 to facilitate the flow or movement of the mixture out of the mixture receptacle 21. The agitator 25 may operate within the hopper 21 to mechanically agitate the contents, e.g. mixing or stirring. Alternatively, an agitator induces a vibration in the walls of the mixture receptacle 21. In yet another embodiment, the mixture receptacle 21 is shaken by way of a percussion type agitator 25.

In one embodiment, the mixture receptacle 21 sides are sloped inward from top to bottom so as to utilize gravity to facilitate the movement of the mixture toward the mixture receptacle exit, the hopper exit port, situated above the conveyor belt system 23. The mixture, e.g. run-of-mine coal, is transported into the barrel 10 by the conveyor belt system 23. In yet another embodiment, the mixture receptacle 21 sides are vertically configured. In yet another embodiment, no hopper is positioned above the conveyor belt system 23 and coal is fed directly onto the conveyor belt 27. In a further embodiment, a chute or slide delivers the run-of-mine coal to the conveyor belt system 23. Alternatively, a chute or slide may deliver coal directly into the barrel 10.

In embodiments utilizing a conveyor belt system 23, the conveyor belt system 23 possesses a conveyor belt 27 driven by a conveyor belt motor 29. The conveyor belt 27 is preferably wrapped around two conveyor belt end rollers 24. One or both of the conveyor belt end rollers 24 is a powered roller and is driven by the conveyor belt motor 29. Conveyor belt support rollers 26 are arranged within the circumference of the conveyor belt 27 and between the two conveyor belt end rollers 24. Both the conveyor belt end rollers 24 and the conveyor belt support rollers 26 are preferably affixed to the conveyor belt frame 22.

The profile of the conveyor belt 27 in previously described embodiments is concave across the conveyor belt 27 or alternatively is substantially flat in a further conveyor system embodiment. Conveyor guides 28 are affixed laterally to the conveyor belt 27 along the conveyor belt frame 22. The conveyor belt 27 inverts around a conveyor belt end roller 24, at which point the mixture, e.g. run-of-mine coal, is dumped into the barrel 10.

A conveyor system frame 30 supports the conveyor belt frame 22 and consists primarily of a plate extending lengthwise into the barrel 10 from the hopper 21 at the rock exit end 12 of the barrel 10 and substantially across the width of the barrel 10. A substantially vertical shield 18 is affixed on the conveyor system frame 30 past the conveyor belt end roller 24 at a sufficient distance to permit the run-of-mine coal to drop through the gap created between the conveyor belt end roller 24 and the shield 18. In one embodiment, the shield 18 is positionable and is adjusted to accommodate the size of the available mixture, e.g. run-of-mine coal. The conveyor system frame 30 may extend from the shield 18 to the low density solids, e.g. coal, exit end 14 of the barrel 10. This inhibits the flow of air across the mixture, e.g. run-of-mine coal, on the conveyor belt 27 and minimizes the opportunity for forced air from the blower 41 to dislodge the low density solids, e.g. coal, on the conveyor belt 27 thereby causing it to prematurely spill over the sides of the conveyor belt 27 into the barrel 10 of the separator 100.

A blower 41 is stationed at the high density solids, e.g. rock from run-of-mine coal, exit end 12 of the barrel 10. Air is used as a fluid media and forced through the barrel 10 at a volumetric rate sufficient to drive low density solids, e.g. coal out of the low density solids exit end 14 of the barrel 10, but small enough to have a minimal effect on high density solids, e.g. rock from run-of-mine coal, which tends to fall to the floor of the barrel 10 because of its significantly greater density than coal. The barrel 10 is lined with at least one helical blade 15 which turns either clockwise or counter-clockwise through the barrel 10 along the interior barrel surface 17 from the high density exit end 12 of the barrel 10 to the low density solids exit end 14 of the barrel 10. The helical blade 15 is preferably continuous and is a single unit one helical blade embodiment and comprised of multiple units connected together to functionally form a single blade in yet another helical blade embodiment. In an embodiment, gaps exist at various positions along the helical blade 15 so as to permit heavier pieces of the low density solids, e.g. coal, to be blown back across the barrel 10 from the high density solids exit end 12 of the barrel 10 to the low density solids exit end 14 of the barrel 10. The barrel 10 rotates on barrel rollers 53 mounted on the carriage frame 51. The direction of the rotation of the barrel 10 is matched to the turns of the helical blade 15 through the barrel 10 so that solids are guided by the turning helical blade 15 toward the high density solids exit end 12 of the barrel 10. In an embodiment, the barrel 10 is rotated by a barrel belt 33 that is configured to engage the teeth a gear ring 35 around the circumference of the barrel 10 along the exterior barrel surface 16. A barrel drive motor 31 engages the barrel belt 33 and drives the rotation of the barrel 10.

Low density solids, e.g. coal, will sometimes fall between the blades of the barrel 10 and will need to be placed back in the stream of forced air to ensure its collection at the rock exit end 12 of the barrel 10. Barriers 19 that run somewhat perpendicular to the run of the helical blade 15 on the interior barrel surface 17 will catch material resting between the turns of the helical blade 15 and force it back into the stream of forced air. The high density solids, e.g. rock from run-of-mine coal, mostly resist the flow of air and continue to move toward the high density solids exit end 12 of the barrel 10 by following the turns of the helical blade 15. The barrel 10 is elevated at the low density solids exit end 14 of the barrel 10 relative to the high density solids exit end 12 of the barrel 10 which provides a gravity assist to the movement of high density solids, e.g. rock from run-of-mine coal, along the turns of the helical blade 15, toward the blower and out the high density solids exit end 12 of the barrel 10.

The low density solids, e.g. coal, exit the low density solids exit end 14 of the barrel 10 as it is susceptible to the fluid stream of air. The greater the mass of an individual piece of low density solid, the shorter the distance it travels after exiting the barrel 10. The barrel 10 is cylindrical and formed as the hollow frustum of a cylinder, and acts as a wind tunnel within the confines of the barrel interior surface 17. As the forced air exits the low density solids exit end 14 of the barrel 10, it is no longer confined and the velocity decreases as the distance it travels from the low density solids exit end 14 of the barrel 10 increases and the high velocity air expands into the environment and loses velocity. As the air velocity decreases it increasingly loses the ability to fluidize the low density solids, e.g. coal, being ejected from the low density solids exit end 14 of the barrel 10. The loss of air velocity over distance from the low density solids exit end 14 of the barrel 10 results in the heavier pieces of low density solids dropping out of the air stream first and the dust and fines traveling the farthest from the low density solids exit end 14 of the barrel 10. The physical segregation of low density solids, e.g. coal, pieces by mass, and thus size, allows the low density solids, e.g. coal, to be recovered according to size.

Figure 5:
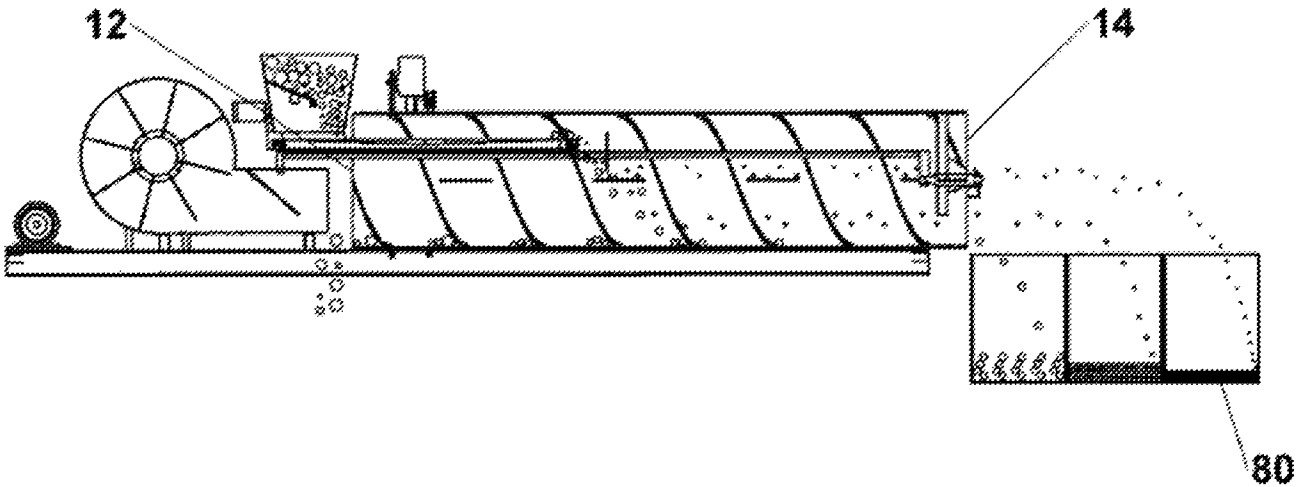
FIG. 5 is a perspective view of the collection bins relative to the separation system.

In some embodiments, a single low density solids receptacle 80 is utilized at the low density solids exit end 14. In additional embodiments, a compartmentalized low density solids receptacle 80 or a plurality of low density solids receptacles 80 are arranged at the low density solids exit end 14 of the barrel 10. In yet other embodiments, the compartments of a receptacle 80 or the plurality of low density solids receptacles 80 are arranged linearly at increasingly further distances from the low density solids exit end 14 of the barrel 10 allows to allow low density solids, e.g. coal, of different sizes to be captured in a segregated manner as shown in FIG. 5.

In an embodiment, screens are used as a filter atop a low density solids receptacle 80. In a further embodiment, the separated low density solids, e.g. coal, captured in each low density solids receptacle 80 could under go further processing as the low density solids, e.g. coal, could be removed from the low density solids receptacle 80 and introduced into another separator 100. Subsequent treatment of separated low density solids, e.g. coal, could utilize separation systems 100 which are optimized for the size of low density solids being introduced into that particular system 100.

What is claimed is:

1. A solids separation system comprising:

(a) a barrel, said barrel formed as a hollow frustum of a cylinder and having a low density solids exit end, a high density solids exit end, and a barrel wall forming an interior barrel surface and an exterior barrel surface;

(b) at least one blade helically wound along said interior barrel surface of said barrel with at least one turn around the circumference of said barrel approximately from said high density solids exit end to substantially said low density solids exit end, and said blade having height, width and length;

(c) barriers affixed to said interior barrel surface, said barriers mounted in a substantially perpendicular orientation between the turns of said helically wound blade;

(d) a carriage on which said barrel is arranged in a substantially horizontal arrangement and further rotatably arranged and inclined so as to elevate said low density solids exit end of said barrel in relation to said high density solids exit end;

(e) a blower placed at said high density solids exit end of said barrel and arranged to force air through said barrel roughly parallel to said barrel wall;

(f) a blower motor arranged to power said blower;

(g) means for rotating said barrel; and (h) means for delivering a mixture into said barrel so that said mixture passes through said forced air.

2. The system of claim 1, wherein said mixture delivery means is selected from the group consisting of conveyor systems and chutes.

3. The system of claim 2, wherein said conveyor system includes a conveyor belt powered by a motor, said conveyor belt extending into said barrel.

4. The system of claim 3, wherein said mixture delivery means further comprises guides which inhibit spillage from said mixture delivery means.

5. The system of claim 3, wherein conveyor system includes a shield, said shield being arranged to inhibit air flow from said blower across said conveyor belt.

6. The system of claim 1, further comprising a mixture receptacle.

7. The system of claim 6, wherein said mixture receptacle has an outlet.

8. The system of claim 7, wherein said mixture receptacle is mounted at said high density solids exit end of said barrel.

9. The system of claim 7, wherein said mixture receptacle possesses a flow regulator to control the rate at which said mixture is emptied from said mixture receptacle.

10. The system of claim 7, wherein said mixture receptacle possesses an agitator to facilitate the emptying of said mixture receptacle.

11. The system of claim 10, wherein said agitator is selected from the group consisting of mixing and receptacle percussion type agitators.

12. The system of claim 1, wherein said means to rotate said barrel utilizes a barrel belt which engages said exterior surface of said barrel.

13. The system of claim 12, wherein said driven barrel belt encompasses said barrel.

14. The system of claim 13, wherein said exterior surface of said barrel possesses at least one surface feature which said barrel belt engages so as to cause said barrel to rotate when said barrel belt is driven by a barrel belt motor.

15. The system of claim 14, wherein said surface feature is a ring of teeth around the circumference of said barrel along said exterior surface that is configured to couple with said barrel belt.

16. The system of claim 1, further comprising at least one low density solids receptacle placed at said low density solids exit end of said barrel.

17. The system of claim 16, wherein a plurality of low density solids collection receptacles are linearly placed at increasing distances from said low density solids exit end of said barrel.

18. The system of claim 17, further comprising screens on at least one of said plurality of low density solids collection receptacles.

19. The system of claim 1, further comprising a plurality of rollers arranged to facilitate the rotation of said barrel on said carriage.

20. The method of employing the system of claim 1 to separate coal and rock from run-of-mine coal.

21. The system of claim 1, wherein said at least one blade is arranged to guide at least a portion of said mixture toward said high density solids exit end as said barrel rotates.

* * * * *